US009494895B2

(12) United States Patent
Mizuno et al.

(10) Patent No.: US 9,494,895 B2
(45) Date of Patent: Nov. 15, 2016

(54) IMAGE FORMING APPARATUS INCLUDING WITH OPPOSITE FIRST AND SECOND WALLS AND WITH FIRST AND SECOND DRIVE AND TRANSFER SYSTEMS MOUNTED RESPECTIVELY TO THE FIRST AND SECOND WALLS

(71) Applicant: KYOCERA Document Solutions Inc., Osaka-shi, Osaka (JP)

(72) Inventors: Masahiko Mizuno, Osaka (JP); Yuki Tamura, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 14/870,066

(22) Filed: Sep. 30, 2015

(65) Prior Publication Data

US 2016/0091838 A1 Mar. 31, 2016

(30) Foreign Application Priority Data

Sep. 30, 2014 (JP) ..... 2014-201061

(51) Int. Cl.
*G03G 15/00* (2006.01)
*G03G 15/16* (2006.01)
*G03G 21/16* (2006.01)

(52) U.S. Cl.
CPC ..... *G03G 15/1615* (2013.01); *G03G 21/1647* (2013.01); *G03G 2221/1657* (2013.01)

(58) Field of Classification Search
CPC ..... G03G 15/1615; G03G 15/757; G03G 21/1857; G03G 2221/1657
USPC ..... 399/167
See application file for complete search history.

(56) References Cited

U.S. PATENT DOCUMENTS

2003/0138271 A1* 7/2003 Cho
2006/0067736 A1* 3/2006 Kim ..... 399/167
2007/0009284 A1* 1/2007 Okamoto
2007/0019994 A1* 1/2007 Choi

FOREIGN PATENT DOCUMENTS

JP 11102096 A * 4/1999
JP 2002-148896 5/2002
JP 2011-232647 11/2011

* cited by examiner

*Primary Examiner* — Walter L Lindsay, Jr.
*Assistant Examiner* — Milton Gonzalez
(74) *Attorney, Agent, or Firm* — Gerald E. Hespos; Michael J. Porco; Matthew T. Hespos

(57) ABSTRACT

An image forming apparatus includes: a driving source including only a first driving motor and a second driving motor; a first transfer system that transfers a first driving force generated by the first driving motor; and a second transfer system that transfers a second driving force generated by the second driving motor. The first transfer system transfers the first driving force only to each image carrier and each developing roller. The second transfer system transfers the second driving force to at least a belt driving roller of an intermediate transfer unit, a fixing roller, and a sheet conveyance roller.

9 Claims, 14 Drawing Sheets

IMAGE FORMING APPARATUS INCLUDING WITH OPPOSITE FIRST AND SECOND WALLS AND WITH FIRST AND SECOND DRIVE AND TRANSFER SYSTEMS MOUNTED RESPECTIVELY TO THE FIRST AND SECOND WALLS

INCORPORATION BY REFERENCE

This application is based on Japanese Patent Application No. 2014-201061 filed with the Japan Patent Office on Sep. 30, 2014, the contents of which are hereby incorporated by reference.

BACKGROUND

The present disclosure relates to an image forming apparatus including image carriers.

An image forming apparatus such as a full-color laser printer or copier includes, for example, a unit of photoconductive drums and developing devices corresponding to four colors of cyan (C), magenta (M), yellow (Y), and black (Bk), an intermediate transfer unit, a fixing unit, and a sheet conveying system. Each of these units includes a rotary member such as a roller, and thus, the image forming apparatus includes a driving motor for driving the rotary member. A color image forming apparatus includes a large number of units including rotary members that need to be driven, compared to a monochrome image forming apparatus. Accordingly, the number of driving motors tends to increase. The use of such a large number of driving motors, however, leads to an increase in costs for the image forming apparatus.

SUMMARY

An image forming apparatus according to an aspect of the present disclosure includes an imaging system, an intermediate transfer unit, a fixing unit including a fixing roller, a sheet conveying system, a driving source, a first transfer system, and a second transfer system.

The imaging system includes a plurality of combinations of image carriers each having a circumferential surface carrying a developed image thereon and developing devices each having a developing roller for supplying developer onto the circumferential surface of the image carrier. The intermediate transfer unit includes an intermediate transfer belt on which the developed image carried on the circumferential surface of the image carrier is primarily transferred and a belt driving roller for driving and running the intermediate transfer belt. The sheet conveying system includes a sheet feeding section for feeding a sheet on which the developed image is to be secondarily transferred from the intermediate transfer belt, a sheet discharge section that receives a sheet on which the developed image has been secondarily transferred, a conveyance passage for guiding the sheet from the sheet feeding section to the sheet discharge section by way of the intermediate transfer unit and the fixing unit, and a sheet conveyance roller disposed in the conveyance passage. The driving source includes only a first driving motor and a second driving motor. The first transfer system transfers a first driving force generated by the first driving motor. The second transfer system transfers a second driving force generated by the second driving motor.

The first transfer system transfers the first driving force only to each of the image carriers and each of the developing rollers. The second transfer system transfers the second driving force to at least the belt driving roller, the fixing roller, and the sheet conveyance roller.

DETAILED DESCRIPTION

Figure 1:
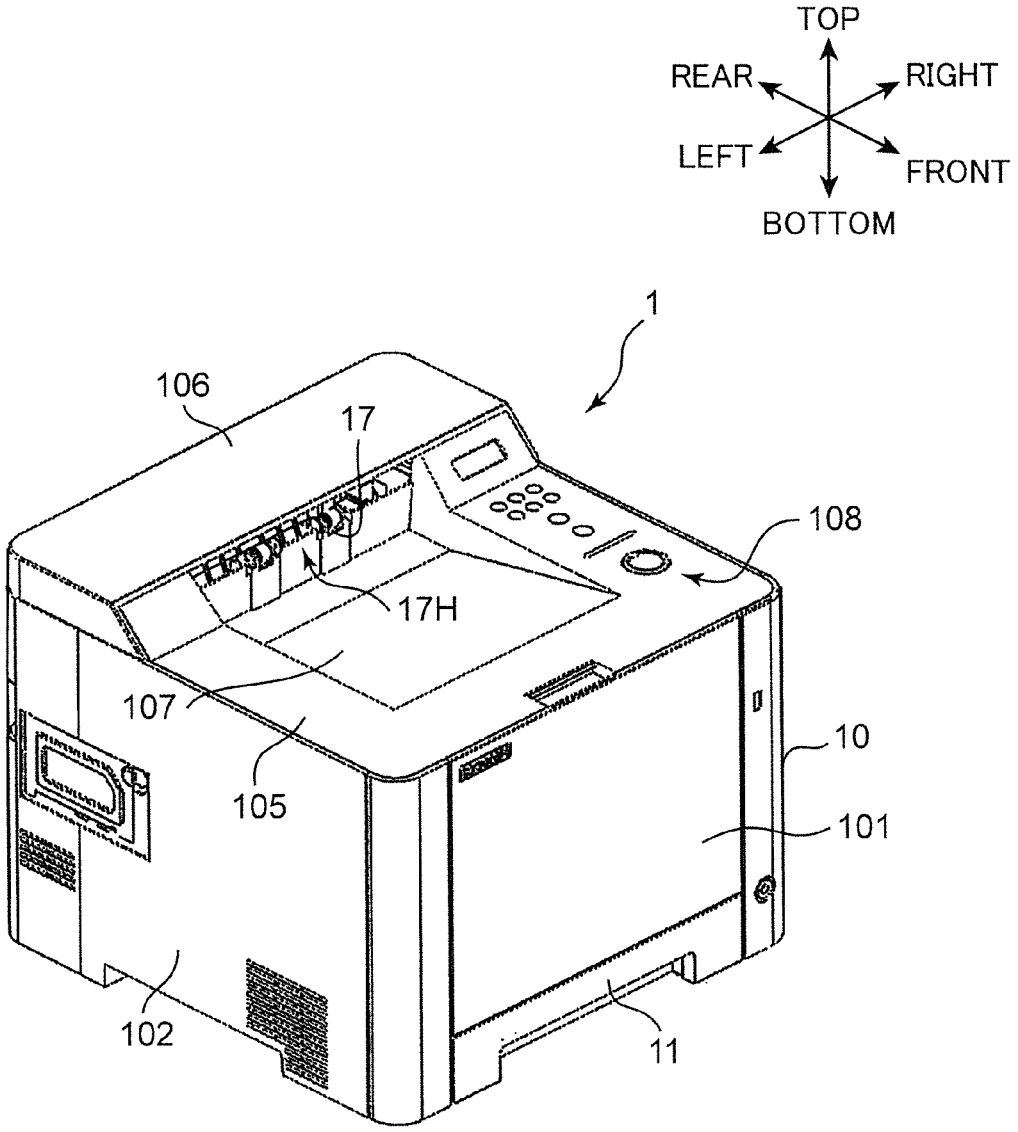
FIG. 1 is a perspective view of an image forming apparatus according to an embodiment of the present disclosure.
Figure 2:
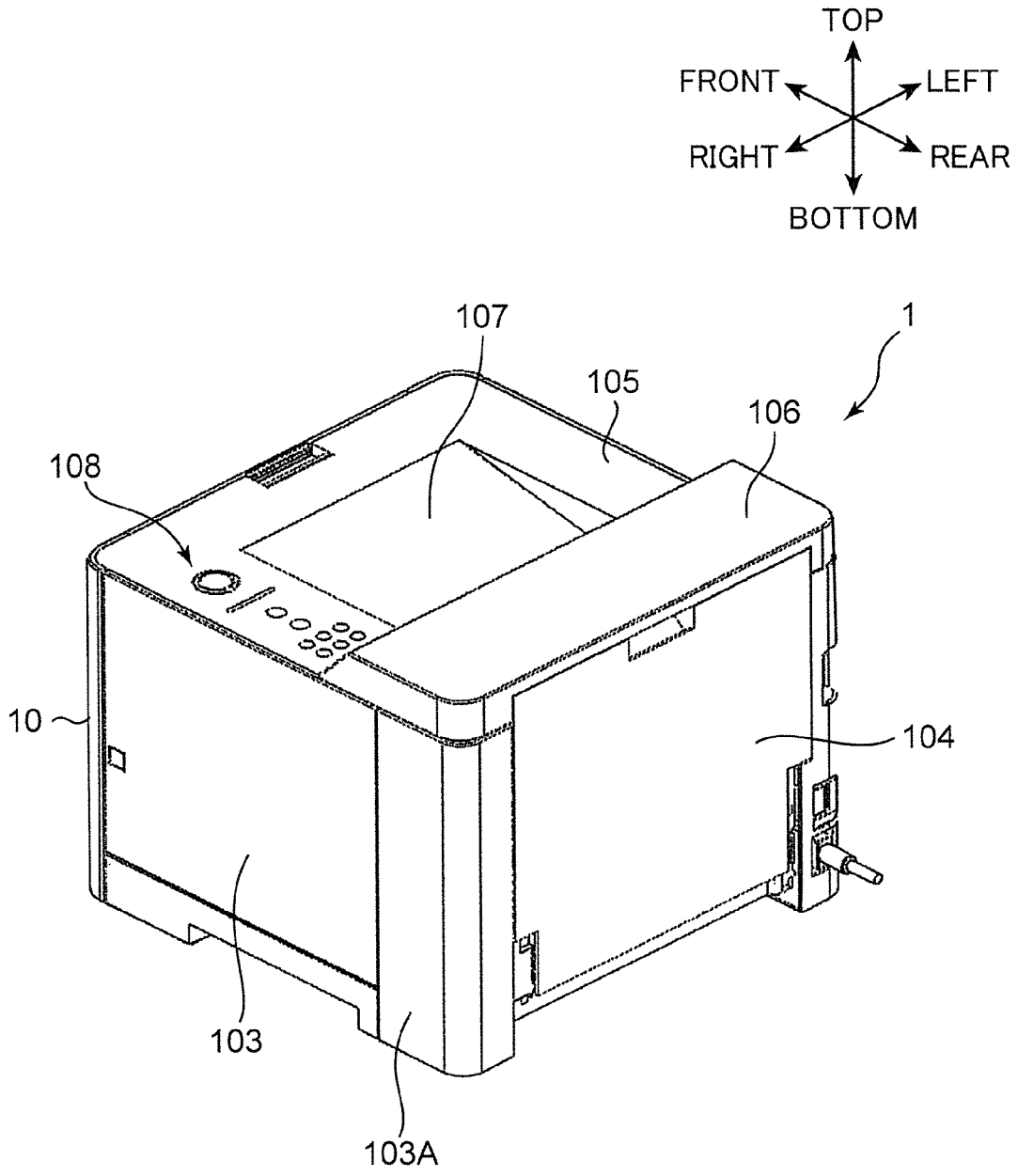
FIG. 2 is a perspective view of the image forming apparatus when viewed from a different direction.

Hereinafter, an embodiment of the present disclosure will be specifically described with reference to the accompanying drawings. FIGS. 1 and 2 are perspective views of an image forming apparatus 1 according to an embodiment of the present disclosure. The image forming apparatus 1 is a full-color printer, but in other embodiments, may be a full-color copier, a facsimile apparatus, or a multifunctional apparatus including these functions.

The image forming apparatus 1 includes a box-shaped body housing 10 that houses various devices for forming an image on a sheet. Vertical and lateral side surfaces of the body housing 10 are covered with a front panel 101, a left panel 102, a right panel 103, and a rear panel 104 that also serve as an exterior. A right rear corner of the body housing 10 is covered with a corner side panel 103A. A top surface of the body housing 10 is covered with a top panel 105. A projecting portion 106 having a sheet discharge port 17H is provided at the rear of the top panel 105, and a sheet discharge tray 107 (sheet discharge section) that receives a sheet discharged from the sheet discharge port 17H is provided in front of the top panel 105. An operation part 108 that receives operation information on the image forming apparatus 1 from a user is disposed near a right end of the top panel 105. A sheet feeding cassette 11 is detachably inserted in a bottom portion of the body housing 10.

Figure 3:
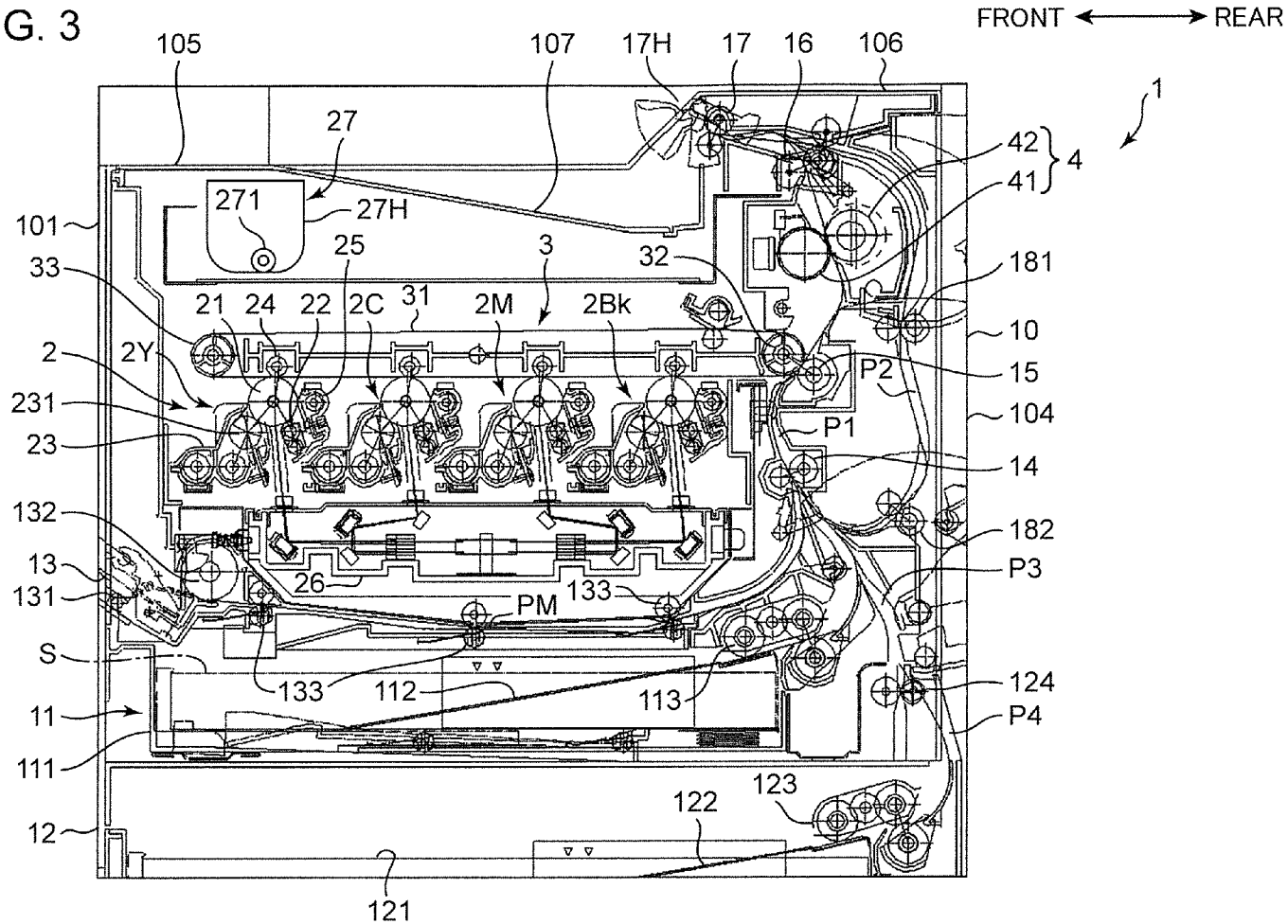
FIG. 3 is a sectional view illustrating an internal configuration of the image forming apparatus.

FIG. 3 is a sectional view illustrating an internal configuration of the image forming apparatus 1. In FIG. 3, a sheet feeding device 12 is added below the sheet feeding cassette 11. The image forming apparatus 1 includes the sheet feeding cassette 11, the sheet feeding device 12, and a manual feed tray 13. The sheet feeding cassette 11, the sheet feeding device 12, and the manual feed tray 13 serve as a sheet feeding section. The image forming apparatus 1 also includes an imaging unit 2 (imaging system) for forming an toner image (developed image), an intermediate transfer unit 3, a fixing unit 4, and a sheet conveying system that has the sheet feeding section and the sheet discharge tray 107 and is used for conveying a sheet in the body housing 10.

The sheet feeding cassette 11 houses a bundle of sheets S on which a toner image is to be transferred. The sheet feeding cassette 11 includes a sheet housing part 111 that houses the sheet bundle, a lift plate 112 on which the sheet bundle is placed, and a sheet feeding roller 113 for feeding the uppermost sheet of the sheet bundle to a main conveyance passage P1. The sheet feeding device 12 is an optional sheet feeding unit attached to the bottom of the body housing 10, and includes a sheet housing part 121, a lift plate 122, and a sheet feeding roller 123, in a manner similar to the sheet feeding cassette 11. The sheet feeding device 12 includes a communication conveyance passage P4 through which a sheet conveyed by the sheet feeding roller 123 passes, and a conveyance roller 124 is disposed at a downstream end of the communication conveyance passage P4. The manual feed tray 13 is a tray on which a sheet is manually placed. A nip roller 131 for picking up a manual feed sheet and a manual sheet feeding roller 132 for conveying the manual feed sheet to a manual feed sheet conveyance passage PM are disposed near the manual feed tray 13. A plurality of conveyance rollers 133 are arranged along the manual feed sheet conveyance passage PM.

The imaging unit 2 includes four image formation units: a yellow image formation unit 2Y, a cyan image formation unit 2C, a magenta image formation unit 2M, and a black image formation unit 2Bk. These image formation units 2Y, 2C, 2M, and 2Bk form toner images corresponding to yellow, cyan, magenta, and black, respectively, and each include a photoconductive drum 21 (image carrier), an electrifying device 22, a developing device 23, a primary transferring roller 24, and a cleaning device 25. That is, the imaging unit 2 includes four combinations of the photoconductive drums 21 and the developing devices 23 respectively corresponding the four colors. In the following description, Y, M, C, and Bk will be additionally assigned when individually distinguishing the photoconductive drums 21 and the developing devices 23 (developing rollers 231) corresponding to the four colors. The imaging unit 2 further includes an optical scanning device 26 commonly used for the image formation units corresponding to the four colors.

Each of the photoconductive drums 21 is a cylindrical member and carries an electrostatic latent image and a toner image (developed image) on a circumferential surface thereof. The photoconductive drum 21 includes a laterally extending drum rotary shaft and is rotationally driven around the drum rotary shaft. Each of the electrifying devices 22 substantially uniformly electrifies the circumferential surface of the corresponding photoconductive drum 21. The optical scanning device 26 includes a light source that emits beams of laser light for scanning, a polygon mirror for deflection, and an imaging optical system. The optical scanning device 26 applies beams of laser light in accordance with image data onto the substantially uniformly electrified circumferential surface of the photoconductive drum 21 and, thereby, forms an electrostatic latent image.

Each of the developing devices 23 is used for developing and eliciting the electrostatic latent image and includes a developing roller 231 for supplying toner (developer) onto the circumferential surface of the corresponding photoconductive drum 21 on which the electrostatic latent image is formed. The developing roller 231 includes a laterally extending roller rotary shaft and is rotationally driven around the roller rotary shaft. With the supply of toner from the developing device 23, a toner image is formed on the circumferential surface of the photoconductive drum 21.

Each of the primary transferring rollers 24 faces the corresponding photoconductive drum 21 from above, and the primary transferring roller 24 and the photoconductive drum 21 constitute a transfer nip with an intermediate transfer belt 31 described later sandwiched therebetween. The primary transferring roller 24 receives a transfer bias for transferring the toner image carried on the photoconductive drum 21 to the intermediate transfer belt 31. After the toner image is transferred onto a sheet S, the cleaning device 25 removes toner remaining on the circumferential surface of the photoconductive drum 21.

The image forming apparatus 1 further includes a toner container 27 (developer container) for replenishing the developing device 23 with toner. FIG. 3 shows only the toner container 27 for the yellow image formation unit 2Y and does not show containers for the other colors. The toner container 27 includes a container body 27H that stores toner of the corresponding color and a feeder 271 (developer feeder) disposed in the container body 27H and conveying the stored toner toward an unillustrated toner discharge port. The feeder 271 includes a laterally extending rotary shaft and a spiral member provided on a circumference of the rotary shaft, and is rotationally driven around the rotary shaft.

The intermediate transfer unit 3 is disposed above the imaging unit 2, includes the intermediate transfer belt 31 on which the toner image carried on the circumferential surface of the photoconductive drum 21 is primarily transferred, and also includes a belt driving roller 32 and a tension roller 33 that drive and run the intermediate transfer belt 31. The intermediate transfer belt 31 is an endless belt and includes an outer circumferential surface onto which the toner image is primarily transferred. The intermediate transfer belt 31 is stretched between the belt driving roller 32 and the tension roller 33 and is caused to run by rotationally driving the belt driving roller 32. A secondary transferring roller 15 is pressed against the belt driving roller 32 with the intermediate transfer belt 31 interposed therebetween, thereby forming a secondary transfer section.

The fixing unit 4 includes a fixing roller 41 incorporating a heat source, and a pressurizing roller 42. The fixing roller 41 and the pressurizing roller 42 form a fixing nip part. Each of the fixing roller 41 and the pressurizing roller 42 includes a laterally extending rotary shaft and is rotationally driven around the rotary shaft. The fixing unit 4 conveys a sheet onto which the toner image is transferred in the secondary transfer section while heating and pressurizing the sheet in the fixing nip part, and thereby, performs a fixing process in which toner is welded onto the sheet.

The image forming apparatus 1 includes, as the sheet conveying system, the sheet feeding section including the sheet feeding cassette 11, the sheet feeding device 12, and the manual feed tray 13 and feeds a sheet onto which a toner image is to be secondarily transferred, the sheet discharge tray 107 that receives a sheet onto which the toner image has been secondarily transferred, the sheet conveyance passages, and the sheet conveyance rollers disposed in these sheet conveyance passages.

The sheet conveyance passages include a main conveyance passage P1 (conveyance passage), a reverse conveyance passage P2, communication conveyance passages P3 and P4, and the manual feed sheet conveyance passage PM described above. The main conveyance passage P1 is a conveyance passage that extends substantially vertically and guides a sheet from the sheet feeding section to the sheet discharge tray 107 by way of the intermediate transfer unit 3 (secondary transfer section) and the fixing unit 4 (fixing nip part). The reverse conveyance passage P2 is a conveyance passage for reversely conveying a sheet from a portion near a downstream end of the main conveyance passage P1 to a portion near an upstream end of the main conveyance passage P1 in performing duplex printing on the sheet. The communication conveyance passage P3 of the body housing 10 and the communication conveyance passage P4 of the sheet feeding device 12 are conveyance passages that communicate with each other when the sheet feeding device 12 is mounted in the body housing 10. A downstream end of the communication conveyance passage P3 and a downstream end of the manual feed sheet conveyance passage PM are connected to portions near the upstream end of the main conveyance passage P1.

In addition to the sheet feeding rollers 113, 123, and 132, the conveyance roller 124, and the conveyance rollers 133 described above, the sheet conveyance rollers of the present embodiment include a resist roller 14, the secondary transferring roller 15, a conveyance roller 16 and a sheet discharge roller 17 disposed at a fixing outlet, which are disposed in the main conveyance passage P1, and reverse conveyance rollers 181 and 182 disposed in the reverse conveyance passage P2.

The resist roller 14 is disposed upstream of the secondary transfer section in the main conveyance passage P1. The resist roller 14 temporarily suspends a sheet and then supplies the sheet to the secondary transfer section at a predetermined time. The secondary transferring roller 15 is opposed to the belt driving roller 32 with the intermediate transfer belt 31 interposed therebetween, thereby forming the secondary transfer section. In the secondary transfer section, a sheet is conveyed downstream while contacting with the secondary transferring roller 15 and the intermediate transfer belt 31.

The conveyance roller 16 is a roller for conveying the sheet that has passed through the fixing unit 4 toward the sheet discharge port 17H. The sheet discharge roller 17 is a roller for discharging a sheet on which an image has been secondarily transferred and fixed from the main conveyance passage P1 toward the sheet discharge tray 107 through the sheet discharge port 17H. The reverse conveyance rollers 181 and 182 are rollers for reversely conveying the sheet in the reverse conveyance passage P2. The pair of the fixing roller 41 and the pressurizing roller 42 also conveys a sheet in the main conveyance passage P1.

Figure 4:
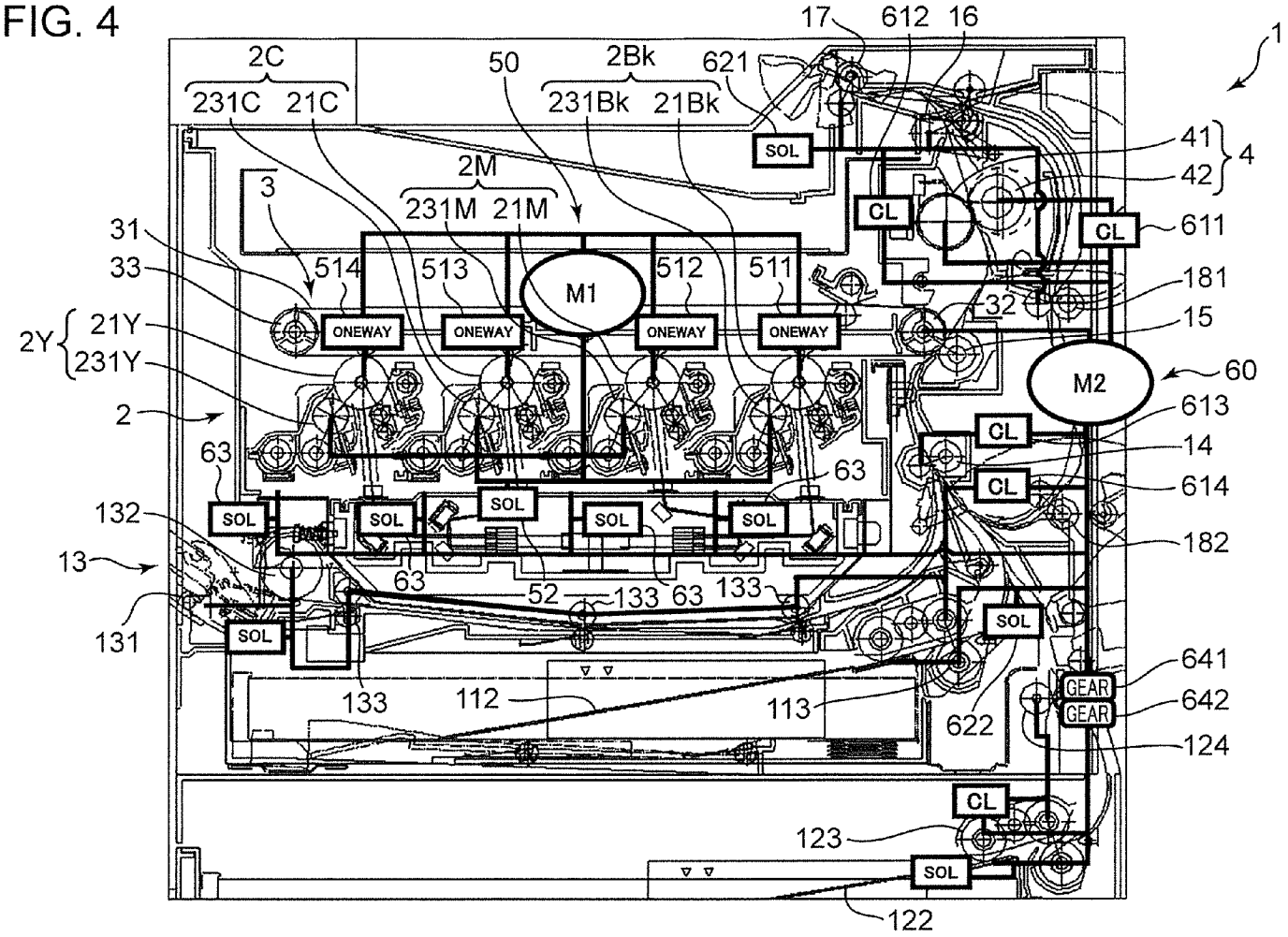
FIG. 4 is a view in which a transfer system is schematically added to the sectional view of FIG. 3.

FIG. 4 is a view in which a driving source and a transfer system are schematically added to the sectional view of the image forming apparatus 1 illustrated in FIG. 3. FIG. 4 does not show the toner container 27. As described above, the image forming apparatus 1 includes a large number of rotary members that need to be rotationally driven, such as the photoconductive drums 21 and the developing rollers 231 included in the imaging unit 2, the belt driving roller 32 included in the intermediate transfer unit 3, the fixing roller 41 and the pressurizing roller 42 of the fixing unit 4, and the conveyance rollers included in the sheet conveying system. As a driving source for driving these rotary members, the image forming apparatus 1 according to the present embodiment includes only two driving motors, that is, a first driving motor M1 and a second driving motor M2.

A first driving force generated by the first driving motor M1 is transferred to predetermined parts by a first transfer system 50. A second driving force generated by the second driving motor M2 is transferred to predetermined parts by a second transfer system 60. The first transfer system 50 and the second transfer system 60 each include a plurality of gear members and various clutch members, which are integrally assembled in a dedicated box together with the driving motor M1 or M2.

Figure 5:
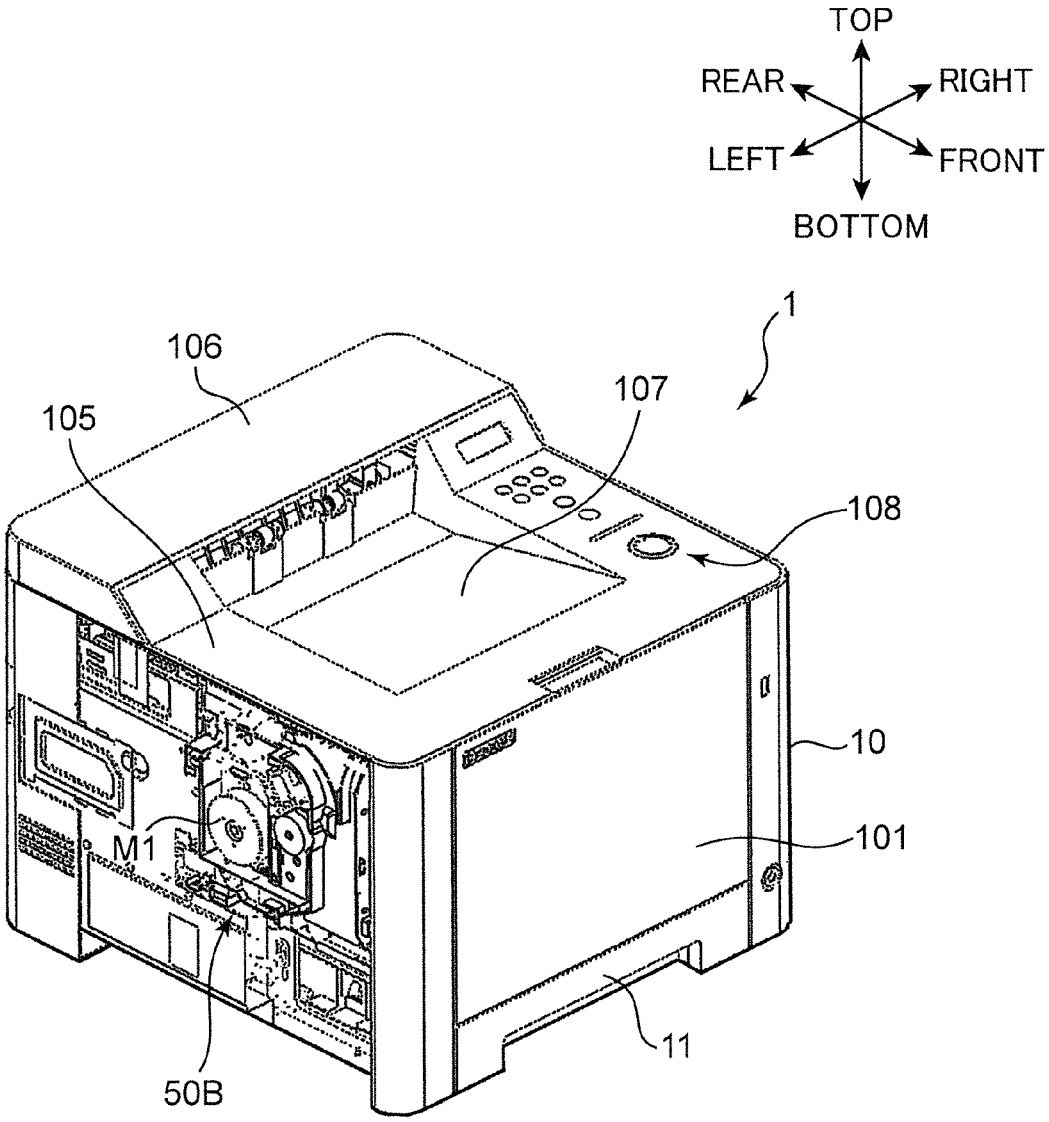
FIG. 5 is a perspective view in which a left panel is detached from the perspective view of FIG. 1.
Figure 6:
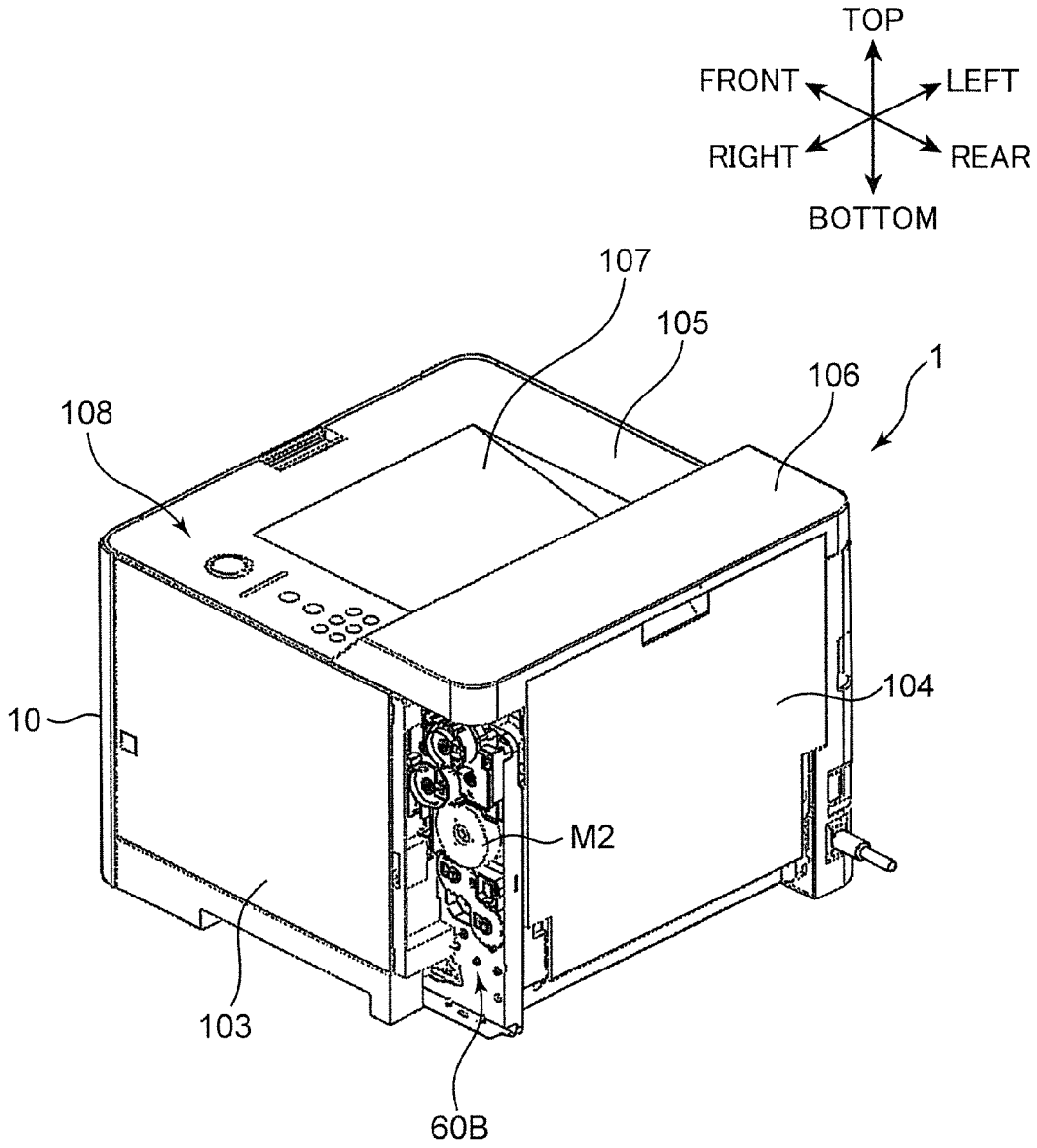
FIG. 6 is a perspective view in which part of a right panel is detached from the perspective view of FIG. 2.

FIGS. 5 and 6 are views in which a first driving box 50B holding the first driving motor M1 and the first transfer system 50 and a second driving box 60B holding the second driving motor M2 and the second transfer system 60 are attached to the body housing 10. FIG. 5 is a perspective view showing a state in which the left panel 102 is detached from the perspective view of FIG. 1. FIG. 6 is a perspective view showing a state in which the right rear corner side panel 103A is detached from the perspective view of the FIG. 2.

The first driving box 50B is attached to a left side surface of the body housing 10. On the other hand, the second driving box 60B is attached to a right side surface of the body housing 10. In this manner, the first driving box 50B and the second driving box 60B are disposed at opposite side surfaces so that vibrations at one side does not easily affect the other. In particular, the first transfer system 50 that affects an image quality is not easily affected by vibrations of the second driving motor M2 and the second transfer system 60.

Figure 7:
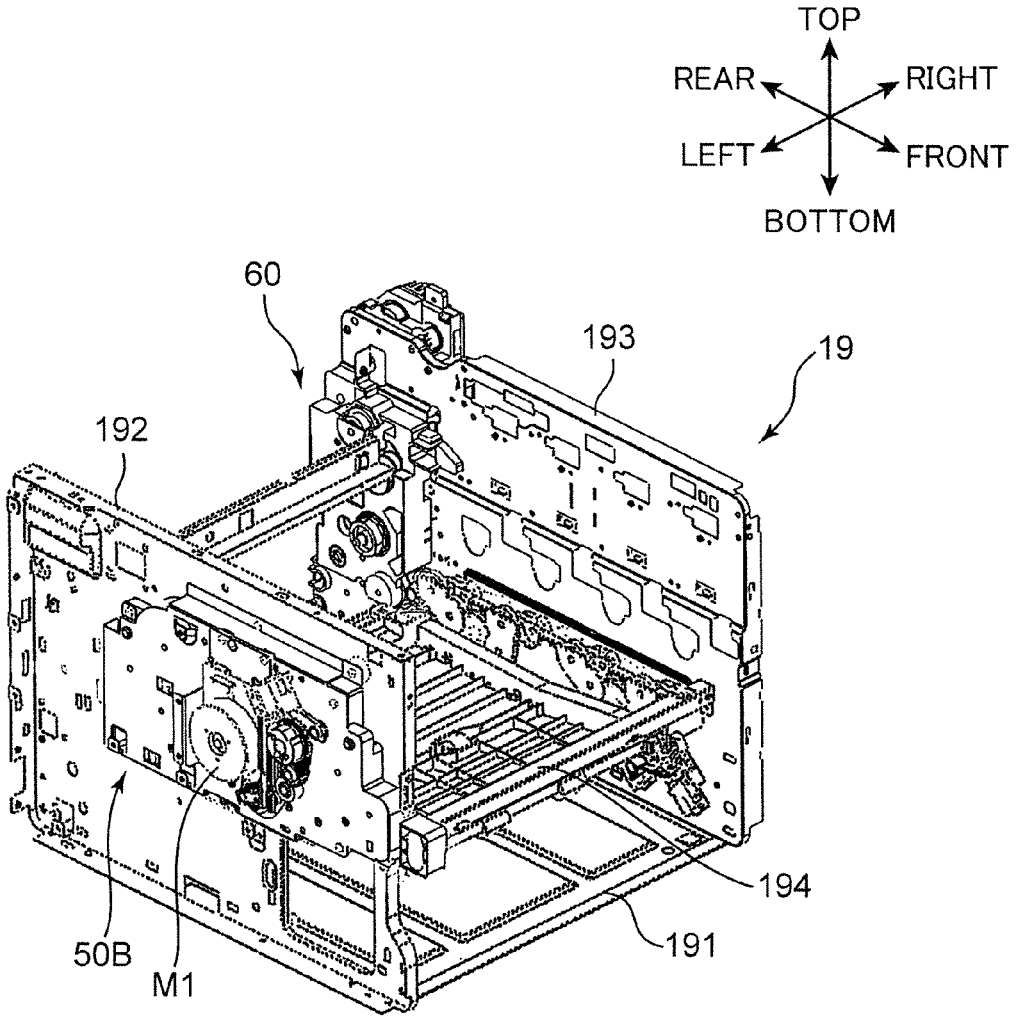
FIG. 7 is a perspective view illustrating a frame structure of the image forming apparatus.
Figure 8:
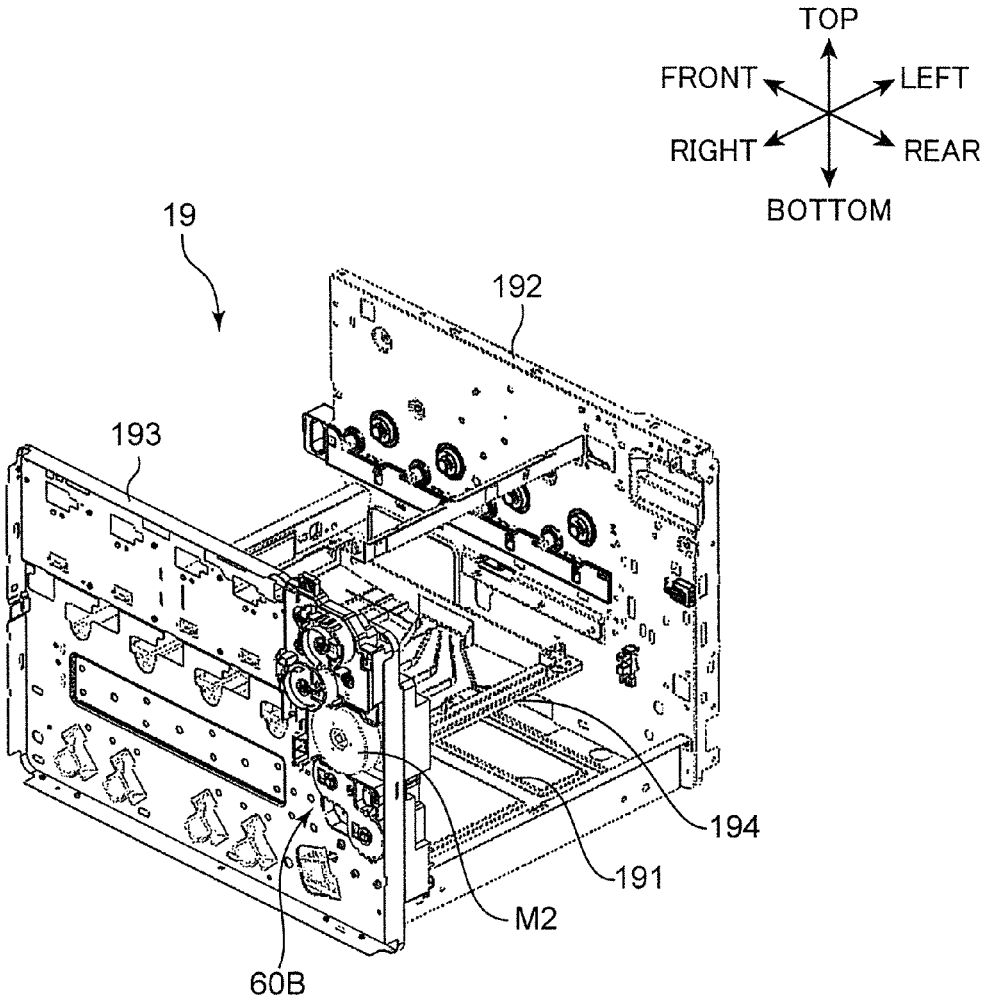
FIG. 8 is a perspective view illustrating the frame structure of the image forming apparatus.

FIGS. 7 and 8 are perspective views illustrating a frame structure 19 constituting a frame of the body housing 10. The frame structure 19 includes a bottom frame 191, a left side frame 192 (first side wall) and a right side frame 193 (second side wall) respectively standing on the left and right edges of the bottom frame 191, and an intermediate frame 194 bridging the side frames 192 and 193 near vertically intermediate portions thereof. A space surrounded by the bottom frame 191 and the side frames 192 and 193 contains and holds the imaging unit 2, the intermediate transfer unit 3, the fixing unit 4, and the sheet conveying system. The intermediate frame 194 is a frame holding a lower surface of the imaging unit 2.

The first driving box 50B is attached to an outer surface of the left side frame 192. A gear coupling portion of the first driving box 50B is exposed at an inner surface of the left side frame 192. The second driving box 60B is attached to a portion of the right side frame 193 near a rear end thereof. In this manner, the first driving box 50B and the second driving box 60B are respectively mounted on the left side frame 192 and the right side frame 193 at opposite positions on the frame structure 19. The frames 192 and 193 sandwich the bottom frame 191 and the intermediate frame 194 therebetween. Thus, each of the driving system driven by the first driving box 50B and the driving system driven by the second driving box 60B is not easily affected by vibrations of the other.

Figure 9:
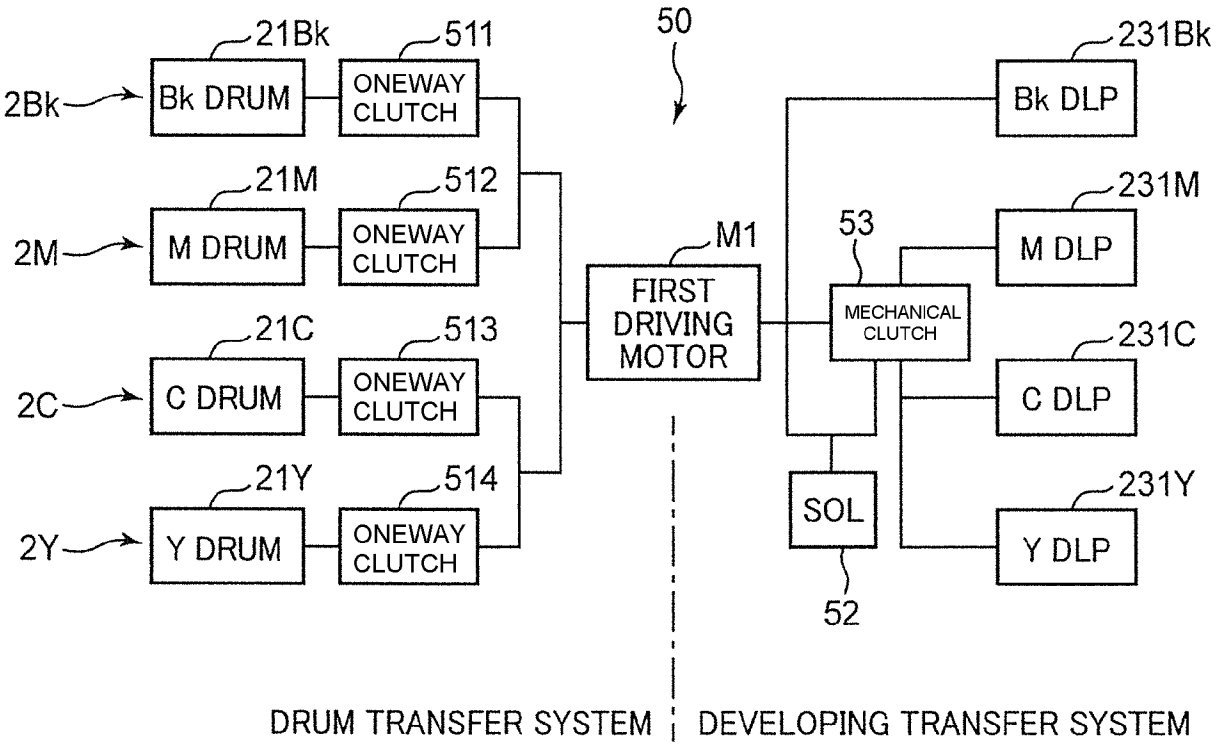
FIG. 9 is a block diagram showing how a driving force is transferred in a first transfer system.
Figure 10:
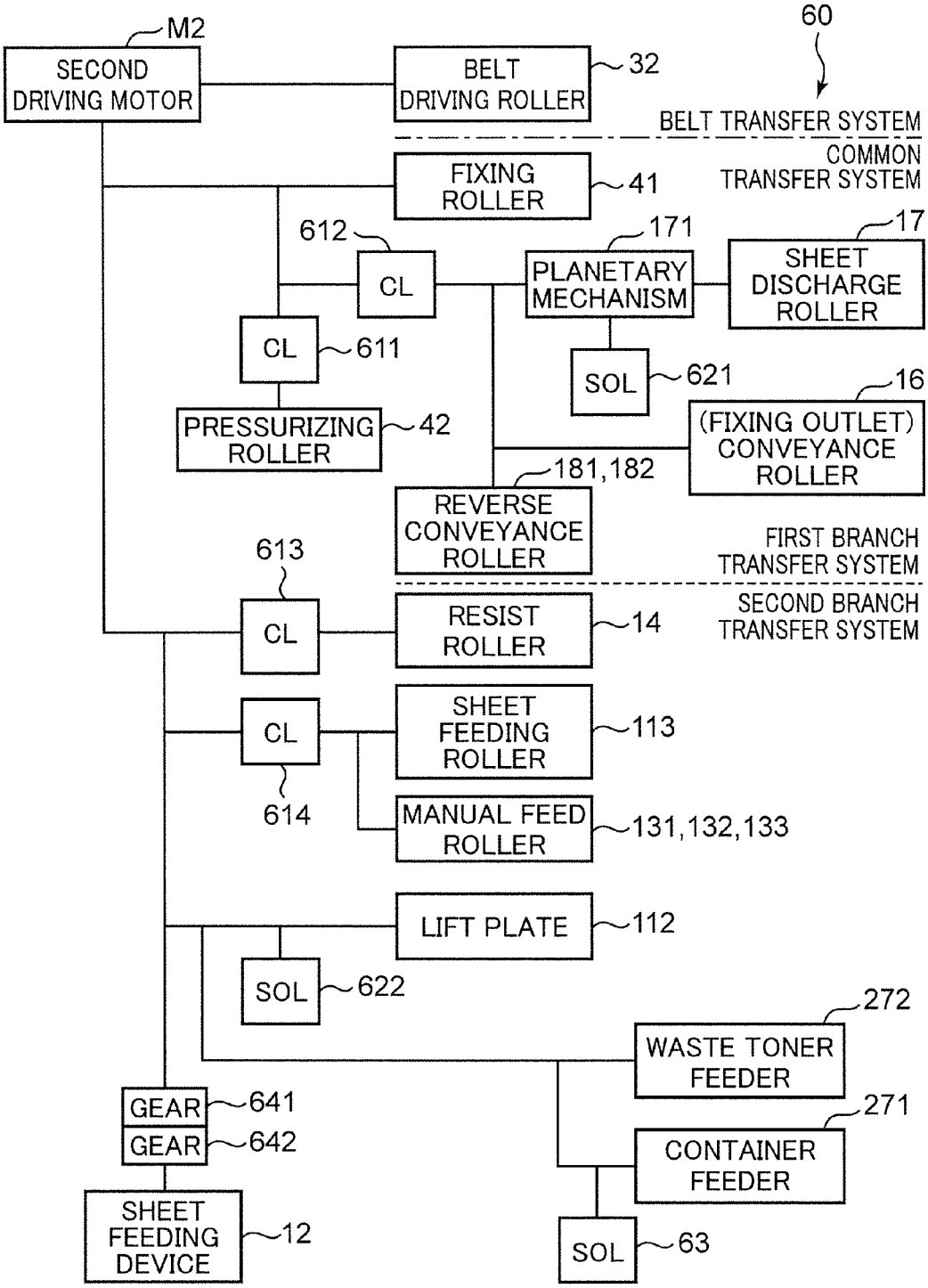
FIG. 10 is a block diagram showing how a driving force is transferred in a second transfer system.

Referring now to FIGS. 4, 9, and 10, the first transfer system 50 and the second transfer system 60 will be specifically described. FIG. 9 is a block diagram showing how a driving force is transferred in the first transfer system 50. FIG. 10 is a block diagram showing how a driving force is transferred in the second transfer system 60. In FIGS. 9 and 10, "ONEWAY" represents a one-way clutch, and "CL" represents an electromagnetic clutch. In addition, "SOL" represents a solenoid that switches the state of some of the driving parts between connection to the transfer system and disconnection from the transfer system.

The first transfer system 50 transfers a first driving force generated by the first driving motor M1 only to the photoconductive drum 21 and the developing roller 231 of the developing device 23. Specifically, the first transfer system 50 consists of two transfer systems to which the first driving force is directly transferred from the first driving motor M1, that is, a drum transfer system (image carrier transfer system) that is a transfer system to the photoconductive drum 21 and a developing transfer system that is a transfer system to the developing roller 231. The first transfer system 50 includes one-way clutches 511, 512, 513, and 514, a solenoid 52, a mechanical clutch 53, and a large number of transmission gears.

The drum transfer system transfers the first driving force to each of the drum rotary shafts of photoconductive drums 21Y, 21C, 21M, and 21Bk respectively included in the image formation units 2Y, 2C, 2M, and 2Bk corresponding to the four colors through the one-way clutches 511, 512, 513, and 514 respectively assembled to the photoconductive drums 21Y, 21C, 21M, and 21Bk. The photoconductive drums 21Y, 21C, 21M, and 21Bk are parallel rotationally driven bodies. When being driven by the first driving motor M1, that is, in forming an image, all the photoconductive drums 21Y, 21C, 21M, and 21Bk are rotationally driven irrespective of whether the image to be formed is a monochrome image or a color image.

The developing transfer system transfers the first driving force to each of the roller rotary shafts of developing rollers 231Y, 231C, 231M, and 231Bk respectively corresponding to the four colors. The mechanical clutch 53 is a clutch for switching between a state in which the first driving force is transferred to the developing rollers 231Y, 231C, and 231M corresponding to yellow, cyan, and magenta color systems and a state in which the first driving force is not transferred to these developing rollers, by performing mechanical engagement and canceling this engagement with the solenoid 52. In a case where the image to be formed is a monochrome image, the mechanical clutch 53 disconnects the developing rollers 231Y, 231C, and 231M from the developing transfer system and establishes a state in which only the developing roller 231Bk corresponding to black is rotationally driven. On the other hand, in a case where a color image is to be formed, the mechanical clutch 53 connects the developing rollers 231Y, 231C, and 231M to the developing transfer system so that all the developing rollers 231Y, 231C, 231M, and 231Bk are rotationally driven.

In the first transfer system 50 having the foregoing configuration, the first driving force is transferred from the first driving motor M1 (first motor output shaft MIS) directly to each of the photoconductive drums 21Y, 21C, 21M, and 21Bk through the drum transfer system, and the first driving force is also transferred from the first driving motor M1 directly to each of the developing rollers 231Y, 231C, 231M, and 231Bk through the developing transfer system. Thus, rotations of the photoconductive drums 21 and the developing rollers 231 can be easily appropriately controlled by controlling the rotation speed of the first driving motor M1. This contributes to excellent image formation.

The second transfer system 60 transfers a second driving force generated by the second driving motor M2 to rotary members that are included in the body housing 10 and needs to be driven, except the photoconductive drums 21 and the developing devices 23. Specifically, the second transfer system 60 transfers the second driving force to the sheet conveying system including the intermediate transfer unit 3, the fixing unit 4, the toner container 27, and the sheet feeding device 12. The second transfer system 60 includes electromagnetic clutches 611, 612, 613, and 614, solenoids 621, 622, and 63, connecting gears 641 and 642, and a large number of transmission gears.

The second transfer system 60 includes two transfer systems to which the second driving force is directly transferred from the second driving motor M2 (second motor output shaft M2S), i.e., a belt transfer system that is a transfer system for transfer to the belt driving roller 32 of the intermediate transfer unit 3 and a common transfer system that is a transfer system for transfer to the other units. The common transfer system includes: a first branch transfer system that transfers the second driving force to the fixing roller 41, the pressurizing roller 42, the sheet discharge roller 17, the conveyance roller 16, and the reverse conveyance rollers 181 and 182; and a second branch transfer system that transfers the second driving force to the resist roller 14, the sheet feeding roller 113, the rollers 131, 132, and 133 of the manual feed system, a container feeder 271, and a waste toner feeder 272. The container feeder 271 and the waste toner feeder 272 convey toner and waste toner, respectively, to the sheet feeding device 12.

The second driving force is transferred from the second driving motor M2 directly to the belt driving roller 32 of the belt transfer system. The belt driving roller 32 is driven to run the intermediate transfer belt 31. Accordingly, the running speed of the intermediate transfer belt 31 can be easily appropriately controlled by controlling the rotation speed of the second driving motor M2. The photoconductive drum 21 is driven by the first driving motor M1, whereas the intermediate transfer belt 31 is driven by the second driving motor M2. Thus, the speeds of the first and second driving motors M1 and M2 can be individually controlled. These contribute to excellent image formation.

The transfer system for transfer to the fixing roller 41 of the first branch transfer system does not incorporate a particular clutch, for example, and the second driving force is always transferred to the fixing roller 41 when being driven by the second driving motor M2. On the other hand, the second driving force is transferred to the pressurizing roller 42 through the electromagnetic clutch 611. The second driving force is transferred to the conveyance roller 16, the sheet discharge roller 17, and the reverse conveyance rollers 181 and 182 through the electromagnetic clutch 612. The rollers are connected to the common transfer system at predetermined sheet conveyance times by using the electromagnetic clutches 611 and 612, and a driving force for conveying a sheet is applied to the rollers.

The transfer system for transfer to the sheet discharge roller 17 incorporates a planetary gear mechanism 171. The solenoid 621 switches the rotation direction of the sheet discharge roller 17 by selecting a joint gear of the planetary gear mechanism 171 from among input gears included in the sheet discharge roller 17. The sheet discharge roller 17 is driven in a forward direction when discharging a sheet to the sheet discharge tray 107, and is driven in a reverse direction when conveying a sheet to the reverse conveyance passage P2 for duplex printing.

The electromagnetic clutch 613 is incorporated in the transfer system for transfer to the resist roller 14 of the second branch transfer system. The resist roller 14 repeatedly performs rotational driving and suspension of rotation for skew correction of sheets and for feeding sheets to the secondary transfer section at predetermined times. This driving is controlled by controlling operation of the electromagnetic clutch 613.

The electromagnetic clutch 614 is incorporated in each of the transfer system for transfer to the sheet feeding roller 113, the nip roller 131 of the manual feed system, and the transfer system for transfer to the manual sheet feeding roller 132 and the three conveyance rollers 133. These rollers 113, 131, 132, and 133 are connected to the common transfer system at predetermined times when a sheet is fed from the sheet feeding cassette 11 or the manual feed tray 13 by means of the electromagnetic clutch 614, and thereby, a driving force for feeding the sheet is applied. A lift driving mechanism for the lift plate 112 of the sheet feeding cassette 11 is also connected to the second branch transfer system. The lift driving mechanism can be connected and disconnected to/from the common transfer system by means of the solenoid 622.

The solenoid 63 is incorporated in each of the transfer systems for transfer to the container feeders 271 of the toner containers 27 corresponding to the individual colors. The solenoid 63 connects the container feeder 271 to the common transfer system at, for example, a timing when the developing device 23 corresponding to the corresponding color needs toner replenishment, and otherwise disconnects the container feeder 271 from the common transfer system. The waste toner feeder 272 is a feeder that is disposed in an unillustrated waste toner conveyance passage, and conveys waste toner to an unillustrated waste toner container. The waste toner feeder 272 is always connected to the common transfer system.

The connecting gear 641 of the body housing 10 and the connecting gear 642 of the sheet feeding device 12 intervene in the transfer system toward the sheet feeding device 12 of the second branch transfer system. The connecting gears 641 and 642 are engaged with each other when the sheet feeding device 12 is installed in the body housing 10. In this manner, the second driving force is transferred to the lift plate 122 and the sheet feeding roller 123 included in the sheet feeding device 12.

Figure 11:
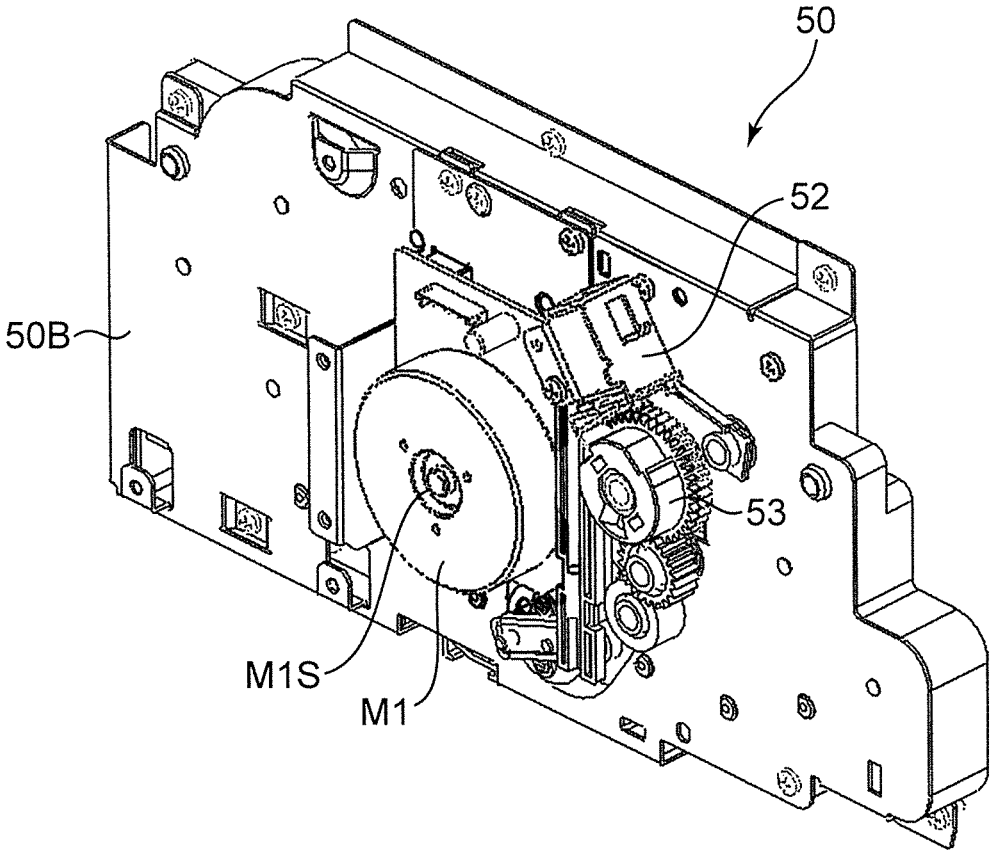
FIG. 11 is a perspective view of a first driving box.
Figure 12:
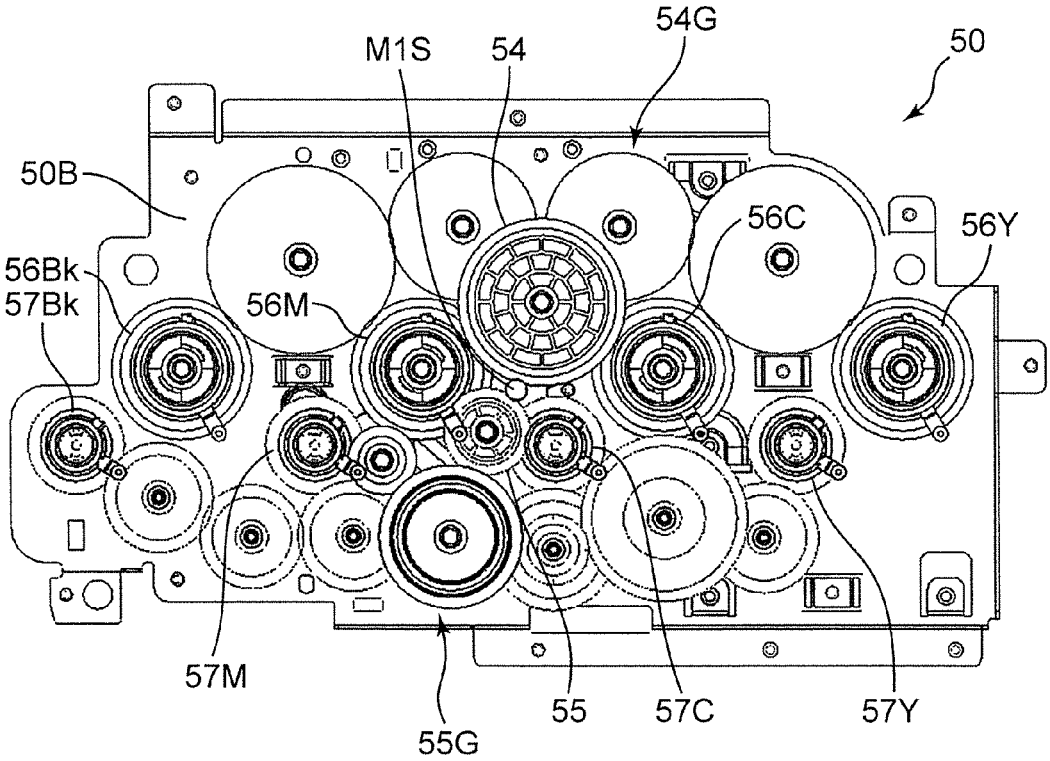
FIG. 12 is a plan view illustrating a gear train included in the first driving box.

FIG. 11 is a perspective view of the first driving box 50B. FIG. 12 is a plan view illustrating a gear train included in the first driving box 50B. FIG. 11 is an enlarged view of the first driving box 50B illustrated in FIG. 7. The surface shown in FIG. 12 is a surface facing the inside of the body housing 10. The first driving box 50B has a housing shape capable of accommodating a large number of gears at the inner surface (FIG. 12). An outer surface (FIG. 11) of the first driving box 50B is provided with the first driving motor M1, the solenoid 52, and the mechanical clutch 53.

The first driving motor M1 includes a first motor output shaft M1S serving as a source of the first driving force. Gears directly meshing with the first motor output shaft M1S are a drum intermediate gear 54 serving as a starting end of the drum transfer system and a developing intermediate gear 55 serving as a starting end of the developing transfer system. Drum gears 56Y, 56C, 56M, and 56Bk are coaxially attached to shaft ends of the drum rotary shafts of the photoconductive drums 21Y, 21C, 21M, and 21Bk, respectively. Developing gears 57Y, 57C, 57M, and 57Bk are coaxially attached to shaft ends of roller shafts of the developing rollers 231Y, 231C, 231M, and 231Bk, respectively.

The drum intermediate gear 54 meshes with a drum idle gear group 54G. The drum idle gear group 54G meshes with the drum gears 56Y, 56C, 56M, and 56Bk. The first driving force is transferred from the drum intermediate gear 54 to each of the drum gears 56Y, 56C, 56M, and 56Bk through the drum idle gear group 54G (where the foregoing configuration is directed to the drum transfer system). Similarly, the developing intermediate gear 55 meshes with the developing idle gear group 55G, and the developing idle gear group 55G meshes with the developing gears 57Y, 57C, 57M, and 57Bk. The first driving force is transferred from the developing intermediate gear 55 to each of the developing gears 57Y, 57C, 57M, and 57Bk through the developing idle gear group 55G (where the foregoing configuration is directed to the developing transfer system). The transfer system having the foregoing configuration contributes to accurate rotation control of the photoconductive drums 21 and the developing rollers 231 achieved by adjusting the rotation speed of the first driving motor M1.

Figure 13:
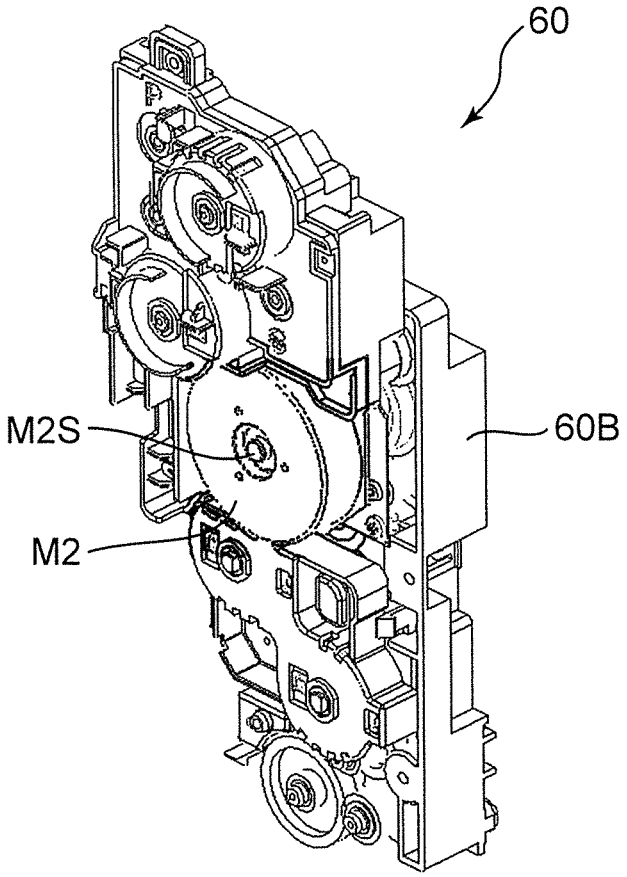
FIG. 13 is a perspective view of a second driving box.
Figure 14:
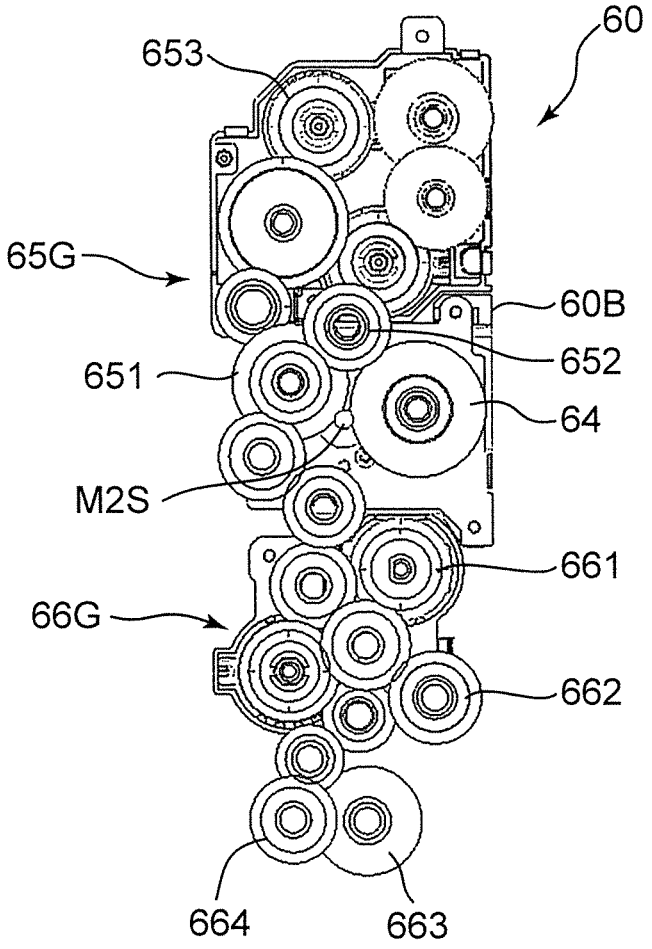
FIG. 14 is a plan view illustrating a gear train included in the second driving box.

FIG. 13 is a perspective view of the second driving box 60B. FIG. 14 is a plan view illustrating a gear train included in the second driving box 60B. FIG. 13 is an enlarged view of the second driving box 60B illustrated in FIG. 8. The surface illustrated in FIG. 14 is a surface facing the inside of the body housing 10. The second driving box 60B has a housing shape capable of accommodating a large number of gears at the inner surface (FIG. 14). The second driving motor M2 includes a second motor output shaft M2S serving as a source of the second driving force.

Gears directly meshing with the second motor output shaft M2S are gears constituting the belt transfer system, i.e., a belt driving gear 64 attached to a roller shaft end of the belt driving roller 32 and a common intermediate gear 651 serving as a starting end of the common transfer system. A fixing gear 652 attached to a shaft end of the fixing roller 41 meshes with the common intermediate gear 651. The common intermediate gear 651 meshes with an idle gear group 65G that transmits the second driving force to, for example, a gear 653 attached to a shaft end of the sheet discharge roller 17 (where the foregoing configuration is directed to the first branch transfer system). The common intermediate gear 651 also meshes with an idle gear group 66G constituting the second branch transfer system. The idle gear group 66G transfers the second driving force to a gear 661 attached to a shaft end of the resist roller 14, the sheet feeding roller 113, a relay gear 662 for relaying a driving force to the manual feed system and the container feeder 271, and an output gear 664 (connecting gear 641) as a source of a driving force to a driving gear 663 of the lift plate 112 and the sheet feeding device 12.

The use of the second driving box 60B enables the second driving force to be transferred from the second motor output shaft M2S directly to the belt driving gear 64, and thus, the speed of the intermediate transfer belt 31 can be accurately controlled. In the main conveyance passage P1, the fixing roller 41 and the resist roller 14 for conveying a sheet are located in parallel branch levels in terms of a path in which the second driving force is transferred. In other words, the second driving force is transferred from the common intermediate gear 651 to both the fixing gear 652 of the fixing roller 41 and the gear 661 of the resist roller. As a result, the sheet conveyance speed can be easily accurately controlled.

In the image forming apparatus 1 according to the present embodiment described above, the photoconductive drums 21 and the developing rollers 231 included in the imaging unit 2 are driven by the first driving motor M1, and the other units and rollers of the sheet conveying system that need to be driven are driven by the second driving motor M2. Thus, only two motors of the first driving motor M1 and the second driving motor M2 are used as driving sources for the mechanical mechanism included in the image forming apparatus 1. Accordingly, the number of necessary driving motors can be reduced. In addition, in the image forming apparatus 1, since the first driving box 50B and the second driving box 60B are respectively disposed on the left side frame 192 and the right side frame 193, each of these boxes is not easily affected by vibrations of the other. As a result, this configuration is advantageous for forming a high-quality image.

The present disclosure is not limited to the foregoing embodiment. For example, the layout shown in FIG. 10 and including a path for transferring a driving force in the second transfer system 60 and arrangement of clutches and solenoids, for example, may be changed as necessary. The arrangement of the conveyance rollers of the sheet conveying system may be changed in accordance with the sheet conveyance passage.

In the above embodiment, only two motors of the first driving motor M1 and the second driving motor M2 are provided as driving sources. These driving sources are directed to members to be driven necessary for forming an image and conveying a sheet, that is, directly required for image formation on the sheet. Thus, a driving motor for driving optional equipment, for example, may be included in the image forming apparatus 1. A polygon motor for driving a polygon mirror, which is generally incorporated in the optical scanning device 26, may be, of course, included in the image forming apparatus 1.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an imaging system including a plurality of combinations of image carriers and developing devices, each of the image carriers having a circumferential surface for carrying a developed image thereon, each of the developing devices having a developing roller for supplying developer onto the circumferential surface of the corresponding image carrier;

an intermediate transfer unit disposed above the imaging system and including an intermediate transfer belt on which the developed image carried on the circumferential surface of the image carrier is primarily transferred and a belt driving roller for driving and running the intermediate transfer belt;

a developer container disposed above the intermediate transfer unit and including a container body that stores developer to be supplied to each of the developing devices and a developer feeder disposed in the container body;

a fixing unit including a fixing roller;

a sheet conveying system including a sheet feeding section for feeding a sheet on which the developed image is to be secondarily transferred from the intermediate transfer belt, a sheet discharge section that receives a sheet on which the developed image has been secondarily transferred, a conveyance passage for guiding the sheet from the sheet feeding section to the sheet discharge section by way of the intermediate transfer unit and the fixing unit, and a plurality of sheet conveyance rollers disposed in the conveyance passage;

a driving source including only a first driving motor and a second driving motor; and a first transfer system for transferring a first driving force generated by the first driving motor and a second transfer system for transferring a second driving force generated by the second driving motor; and a box-shaped body housing that houses the imaging system, the intermediate transfer unit, the fixing unit, and the sheet conveying system; wherein the body housing includes a first side wall and a second side wall that are opposed to each other, the first driving motor and the first transfer system are attached to the first side wall, and the second driving motor and the second transfer system are attached to the second side wall, the first transfer system transfers the first driving force only to each of the image carriers and each of the developing rollers, and the second transfer system transfers the second driving force to at least the belt driving roller, the fixing roller, and the sheet conveyance rollers and the developer feeder.

2. The image forming apparatus according to claim 1, wherein the first driving motor includes a first motor output shaft, the first transfer system includes an image carrier transfer system that transfers the first driving force from the first motor output shaft to each of the image carriers, and a developing transfer system that transfers the first driving force from the first motor output shaft to each of the developing rollers.

3. The image forming apparatus according to claim 1, wherein the second driving motor includes a second motor output shaft, and the second transfer system includes a belt transfer system that transfers the second driving force from the second motor output shaft to the belt driving roller, and a common transfer system that transfers the second driving force from the second motor output shaft to at least the fixing roller and the sheet conveyance rollers.

4. The image forming apparatus according to claim 3, wherein the plurality of sheet conveyance rollers includes a sheet feeding roller that feeds a sheet from the sheet feeding section to the conveyance passage, a resist roller disposed upstream of a portion of the conveyance passage where the secondary transfer is performed, and a sheet discharge roller that discharges a sheet from the conveyance passage to the sheet discharge section, the common transfer system includes a first branch transfer system that transfers the second driving force to the fixing roller and the sheet discharge roller, and a second branch transfer system that transfers the second driving force to the resist roller and the sheet feeding roller.

5. The image forming apparatus according to claim 4, wherein the second driving force is transferred from the second branch transfer system to the developer feeder.

6. The image forming apparatus according to claim 1, further comprising:

a switching member incorporated in the second transfer system and selectively connecting and disconnecting the developer feeder to and from the second transfer system.

7. The image forming apparatus according to claim 6, further comprising: a clutch incorporated in the first transfer system, the clutch switching between a state in which the first driving force is transferred to at least one of the developing rollers and a state in which the driving force is not transferred to the one of the developing rollers.

8. The image forming apparatus according to claim 1, wherein:

the sheet feeding section includes a sheet feeding cassette for housing the sheet, the sheet feeding cassette including a lift plate on which the sheet is placed and paid lift driving mechanism for the left plate, the image forming apparatus further comprising:

a switching member incorporated in the second transfer system and selectively connecting and disconnecting the lift driving mechanism to and from the second transfer system.

9. The image forming apparatus according to claim 1, wherein the sheet feeding section includes a sheet feeding cassette for housing the sheet and a sheet feeding device arranged below the sheet feeding cassette, the image forming apparatus further comprising:

a connecting gear incorporated in the second transfer system and transferring the second driving force to the sheet feeding device.

* * * * *